United States Patent [19]

Enik

[11] 3,944,108

[45] Mar. 16, 1976

[54] COLLECTOR BOX

[76] Inventor: Joseph Enik, 234 Globe St., Union, N.J. 07083

[22] Filed: Aug. 1, 1975

[21] Appl. No.: 601,210

[52] U.S. Cl. ..... 220/18; 220/85 H; 248/205 R; 248/295

[51] Int. Cl.[2] ..... B65D 25/24

[58] Field of Search ..... 220/18, 85 R, 85 H; 312/243, 253, 277; 248/205 R, 214, 295, 259, 260, 99, 100, 101; 206/549; 269/16

[56] References Cited

UNITED STATES PATENTS

| | | | |
|---|---|---|---|
| 960,524 | 6/1910 | Elkin | 312/277 |
| 2,726,837 | 12/1955 | Jameson | 248/359 |
| 3,081,865 | 3/1963 | Pugsley | 206/549 |
| 3,712,696 | 1/1973 | McDonnell | 312/253 |

*Primary Examiner*—George E. Lowrance
*Assistant Examiner*—Allan N. Shoap
*Attorney, Agent, or Firm*—Norman N. Popper

[57] ABSTRACT

A collector box comprising a receptacle with at least one generally hollow sleeve attached to receptacle with a passage therethrough extending in a generally vertical direction and a support slidable in the passage; the bottom of the support having an enlargement, larger in diameter than the passage and the top of the support having an offset arm with a generally flat support pad.

8 Claims, 2 Drawing Figures

COLLECTOR BOX

BACKGROUND OF THE INVENTION

1. Field of the Invention:

This invention relates generally to collector boxes and particularly to such boxes having self-contained but extendable support arms that may be manipulated to suspend the collector box at the edge of a table or other horizontal surface so that material may be swept into the collector box.

2. Prior Art:

Collector boxes for attachment to tables are well-known. But convenience for attaching and detaching them is not usually featured. Furthermore, the attachment media are usually not a permanent part of the collector box and are not capable of being retracted to within the box. Typical examples of collector boxes are U.S. Pat. Nos. 3,794,280, 3,162,414, 1,020,581, 2,637,918, and 949,662.

SUMMARY OF THE INVENTION

It has been found that a collector box may be formed which when closed, contains a permanently attached suspension medium and when opened, may have that suspension medium withdrawn from the collector box and used to suspend the collector box at the edge of the table, enabling appropriate items to be swept off the edge of the table and into a box. Such boxes are useful in the assembly of electronic apparatus where small elements such as resistors or capacitors are most conveniently kept separate from other similar resistors or capacitors having a different electrical characteristics. The small parts may be spilled from the box onto a working surface and then when an appropriate number have been utilized, the remainder may be conveniently swept off the table into the collector box. Numerous other uses for such a collector box may be found, such as holding markers for games, such as bingo, lotto, etc., wherein at the conclusion of the play, the small markers may be swept off into the box and the box closed in a most convenient and simple manner with the means for suspending the box retracted into the box.

DESCRIPTION OF THE DRAWINGS

These objects and advantages as well as other objects and advantages may be attained the device shown by way of illustration in the drawings in which.

PREFERRED EMBODIMENT

Figure 1:
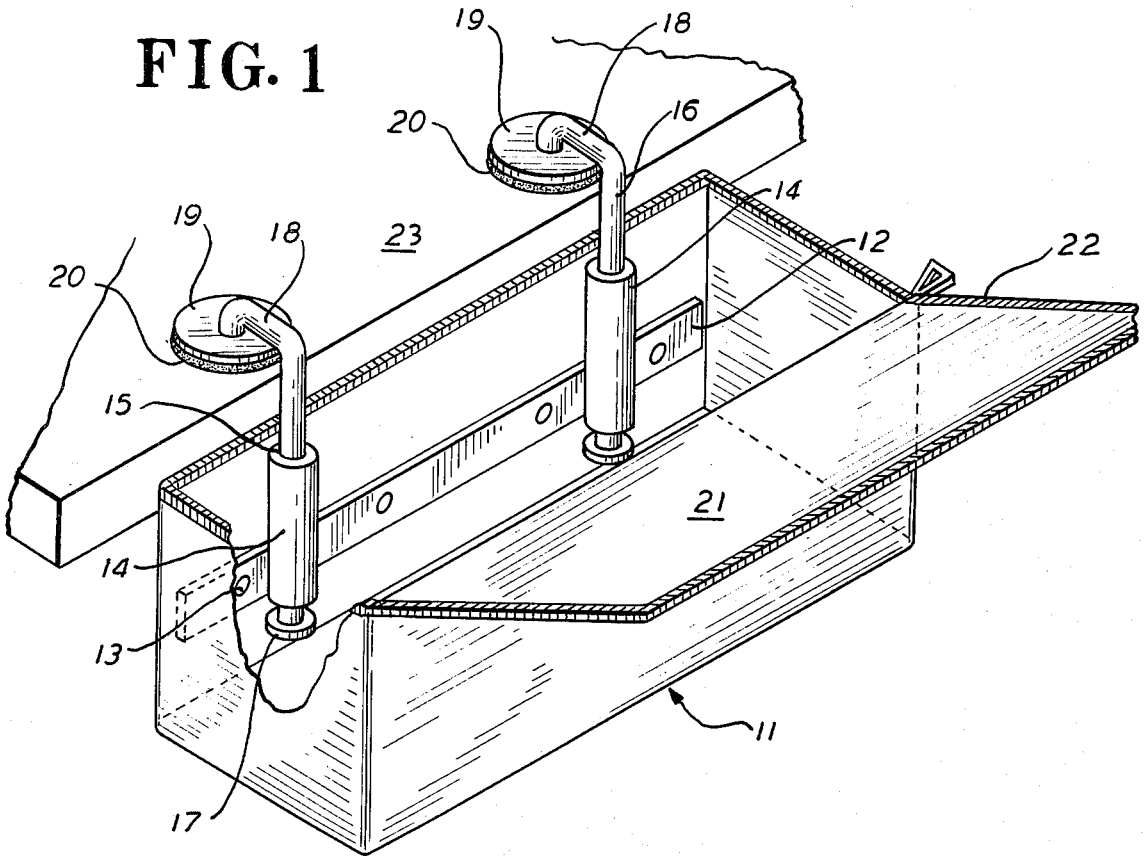
FIG. 1 is perspective view showing the collector box suspended from a table.
Figure 2:
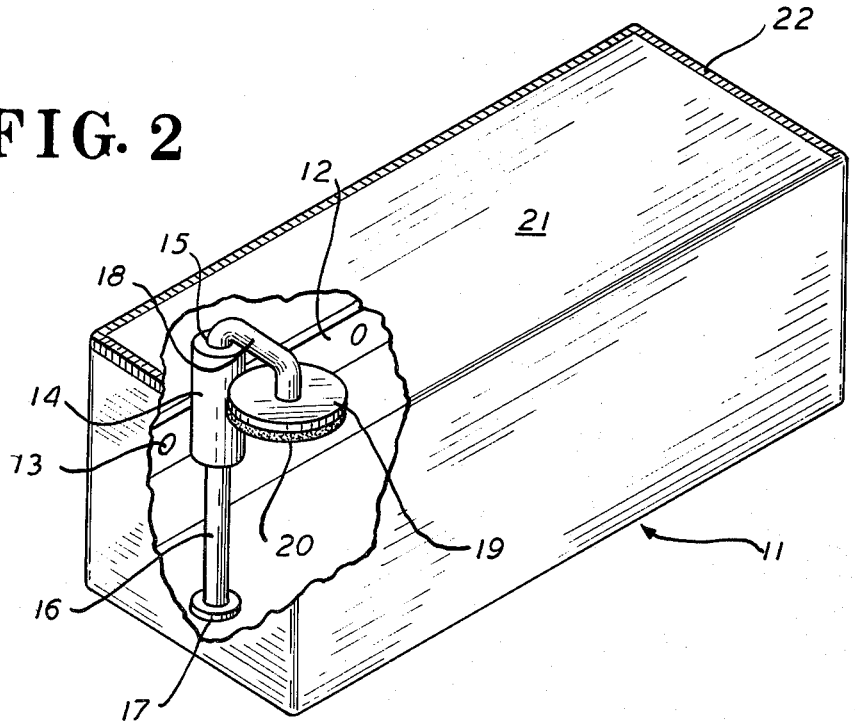
FIG. 2 is a perspective view with the side of the box exploded away showing the suspending means retracted into the box.

Referring now to the drawings in detail. The invention provides a generally rectangular receptacle which may be made of wood, plastic, metal or other suitable material. The receptacle 11 may even be a soft fabric bag. Fastened inside of the receptacle 11 is a bar 12 which may be attached to the receptacle 11 by any suitable means such as by adhesives or by rivets 13. Attached to the bar 12 near either end and adjacent to the opposite ends of the receptacle 11, there is a hollow sleeve 14. This hollow sleeve 14 has a generally vertical passage or bore 15. The passage slidably receives a generally vertical support 16 which is captured in the passage by a flanged enlargement 17 in threaded engagement with the bottom of the support 16 and an offset arm 18 extending perpendicularly from the slidable support 16. At the end of the offset arm 18, there is attached a generally horizontally disposed flat support 19. The bottom surface of the support 19 may be provided with a high-friction pad 20 to hold the support arm in non-slipping engagement with a surface to which it is applied. Thus when the arms are withdrawn from inside of the box, they may be rotated in a direction so that they extend outside of the box and can be rested upon a table or other surface to hold the box suspended from the table top. When the receptacle 11 has served its purpose, the arms 18 may be rotated until the support 19 is over the receptacle 11. Then the slidable support may be returned to within the confines of the receptacle 11. A lid 21 may thereupon be closed. When it is desired to use the receptacle 11 again, the lid is opened, the slidable supports are slid out of the box and the arms rotated to bring the support into position to suspend the receptacle 11 at the edge of a table.

A zipper type closure fastener 22 or some other type of latch or securing means to hold the contents of the receptacle 11 securely enclosed may be added.

Those who are charged with the duty of applying minute components to an electronic device (for example) may deposit the contents on a table 23, select the part or parts required, and sweep the unused parts back into the receptacle 11.

Persons playing Lotto or Bingo, may similarly use the receptacle 11 as a supply of markers, and after each game, sweep the markers off the game card, back into the receptacle 11.

Other uses are readily apparent.

What is claimed is:

1. A collector box comprising:

a. a receptacle, b. a rigid bar attached to the inside of the receptacle, c. a hollow sleeve attached to the bar, d. a generally vertical passage in the hollow sleeve, e. a vertical support slidable and rotatable in the passage, f. an offset arm extending generally perpendicularly to the vertical support at the top thereof, g. a generally horizontal flat support at the end of the offset arm, h. an enlargement in the bottom of the vertical support, to retain the vertical support in the vertical passage.

2. A collector box according to claim 1 and a. the vertical support and offset arm dimensioned to slide entirely into the receptacle when the vertical support is rotated to position the offset arm over the receptacle, b. the vertical support dimensioned to slide upwardly sufficient to permit the offset arm to extend out of and to rotate beyond the receptacle, c. the bottom of the flat support provided with a high friction pad, d. a lid in the receptacle, e. means to hold the lid closed when the vertical support and offset arm are rotated and slide entirely into the receptacle.

3. A collector box according to claim 1 and a. the vertical support and offset arm dimensioned to slide entirely into the receptacle when the support is rotated.

4. A collector box according to claim 1 and a. the vertical support dimensioned to slide upwardly sufficient to permit the offset arm to extend out of and to rotate beyond the receptacle.

5. A collector box according to claim 1, and a. a horizontally disposed flat support on the end of the offset arm.

6. A collector box according to claim 4 and a. the bottom of the flat support provided with a high friction pad.

7. A collector box according to claim 1 and a. a lid on the receptacle.

8. A collector box according to claim 1 and a. means to hold the lid closed when the vertical support and offset arm are reotated and slide entirely into the receptacle.

* * * * *